US010393447B2

(12) United States Patent
Cool

(10) Patent No.: US 10,393,447 B2
(45) Date of Patent: Aug. 27, 2019

(54) HEAT EXCHANGER, METHOD FOR FORMING THEREOF AND USE THEREOF

(71) Applicant: Intergas Heating Assets B.V., Coevorden (NL)

(72) Inventor: Peter Jan Cool, Lochem (NL)

(73) Assignee: Intergas Heating Assets B.V., Coevorden (NL)

( * ) Notice: Subject to any disclaimer, the term of this patent is extended or adjusted under 35 U.S.C. 154(b) by 216 days.

(21) Appl. No.: 15/110,461

(22) PCT Filed: Jan. 9, 2015

(86) PCT No.: PCT/IB2015/000113
§ 371 (c)(1),
(2) Date: Jul. 8, 2016

(87) PCT Pub. No.: WO2015/104634
PCT Pub. Date: Jul. 16, 2015

(65) Prior Publication Data

US 2016/0377349 A1 Dec. 29, 2016

(30) Foreign Application Priority Data

Jan. 9, 2014 (NL) ..... 2012066

(51) Int. Cl.
*F28D 9/00* (2006.01)
*F24H 1/28* (2006.01)
(Continued)

(52) U.S. Cl.
CPC ..... *F28D 9/0037* (2013.01); *F24H 1/282* (2013.01); *F24H 9/0021* (2013.01);
(Continued)

(58) Field of Classification Search
CPC .. F28D 9/0037; F28D 9/0031; F28D 21/0007; F28D 2021/0024; F24H 1/282; F24H 9/0021; F24H 9/0026; F28F 13/08
(Continued)

(56) References Cited

U.S. PATENT DOCUMENTS 1,805,165 A 5/1931 Denney
1,966,133 A * 7/1934 Pieper ..... F24D 3/087 165/162

(Continued)

FOREIGN PATENT DOCUMENTS

DE 19546190 C1 4/1997
DE 102010010671 A1 9/2011

(Continued)

OTHER PUBLICATIONS

International Search Report and Written Opinion issued in corresponding International Application No. PCT/IB2015/000113, dated May 8, 2015.

*Primary Examiner* — Joel M Attey
(74) *Attorney, Agent, or Firm* — Banner & Witcoff, Ltd.

(57) ABSTRACT

The invention relates to a heat exchanger, comprising a hollow central body which is received in a housing and defines an inner channel for a first medium, wherein a space surrounding the central body in the housing defines at least one outer channel for a second medium, wherein the central body has on either side parts which protrude from a main plane thereof and are connected to mutually opposite parts of the housing and which bound the outer channel such that the outer channel has a meandering form substantially parallel to the main plane of the central body.
The invention further relates to a method for forming such a heat exchanger, and to a method for use thereof.

15 Claims, 13 Drawing Sheets

(51) Int. Cl.
*F28F 13/08* (2006.01)
*F28D 21/00* (2006.01)
*F24H 9/00* (2006.01)

(52) U.S. Cl.
CPC ..... *F24H 9/0026* (2013.01); *F28D 21/0007* (2013.01); *F28F 13/08* (2013.01); *F28D 9/0031* (2013.01); *F28D 2021/0024* (2013.01)

(58) Field of Classification Search
USPC ..... 165/109.1
See application file for complete search history.

(56) References Cited

U.S. PATENT DOCUMENTS

| | | | | |
|---|---|---|---|---|
| 4,688,631 | A * | 8/1987 | Peze | F28D 9/0037 165/166 |
| 6,206,089 | B1 | 3/2001 | Uchikawa et al. | |
| 2012/0138280 | A1* | 6/2012 | Angermann | F28D 9/0037 165/166 |
| 2014/0261241 | A1* | 9/2014 | Deckers | F24H 1/32 122/18.31 |

FOREIGN PATENT DOCUMENTS

| | | | |
|---|---|---|---|
| FR | 2953918 | A1 | 6/2011 |
| JP | 2003279291 | A | 10/2003 |
| RU | 2455605 | C1 | 7/2012 |

* cited by examiner

HEAT EXCHANGER, METHOD FOR FORMING THEREOF AND USE THEREOF

RELATED APPLICATION DATA

This application is a National Stage Application under 35 U.S.C. 371 of co-pending PCT application PCT/IB2015/000113 designating the United States and filed Jan. 9, 2015; which claims the benefit of Dutch patent application number 2012066 and filed Jan. 9, 2014, each of which are hereby incorporated by reference in their entireties.

FIELD OF THE INVENTION

The invention relates to a heat exchanger, comprising a hollow central body which is received in a housing and defines an inner channel for a first medium, wherein a space surrounding the central body in the housing defines at least one outer channel for a second medium, wherein the central body has on either side parts protruding from a main plane thereof and the central body comprises at least two substantially parallel profiled plates connected locally to each other. Such a heat exchanger is known in different variants.

BACKGROUND

Heat exchangers are applied in many fields in order to transfer heat from a medium with relatively high temperature to a medium with relatively low temperature. Heat exchangers can be intended to cool relatively hot media. Heat exchangers can on the other hand also be intended to heat a relatively cold medium. This is for instance the case when heat exchangers are applied in central heating systems (CHs) or tap water systems. Water is heated in such systems by being brought into heat-exchanging contact with flue gases of a burner.

Conflicting requirements are often set for heat exchangers, and particularly heat exchangers for CH installations and tap water systems. The media thus have to be able to flow through the channels properly, i.e. with low pressure losses, and be brought into intensive contact with each other. At the same time a heat exchanger must be of relatively simple construction and capable of production at low cost and in large series. It must also be possible to clean and service heat exchangers in simple manner.

U.S. Pat. No. 1,966,133 discloses a heat exchanger comprising two castings. The castings are provided with a peripheral flange with openings, whereby they can be clamped against each other with bolts. Baffle plates likewise provided with a peripheral flange are clamped between the castings, whereby the heat exchanger can be disassembled, for instance for the purpose of cleaning operations or replacement of parts.

DE-C1-195 46 190 relates to a heat exchanger provided with a double plate-shaped pipe of a rectangular cross-section. Combustion gases flow from a combustion chamber in opposite directions along a water flow for heating. The outer channels transport the hot combustion gases which heat the water in the inner channel lying therebetween.

SUMMARY

The invention now has for its object to provide an improved heat exchanger.

According to the invention this is achieved in that the parts protruding from the main plane of the central body are connected to mutually opposite parts of the housing, wherein the protruding parts bound the outer channel such that the outer channel has a meandering form substantially parallel to the main plane of the central body. A good heat transfer is obtained by means of the meandering form of the outer channel. And because the boundary of the outer channel is formed by connecting the protruding parts of the central body locally to the housing, the heat exchanger is of simple construction.

Both the inner channel and the outer channel can be well defined in the heat exchanger according to the invention. A desired flow characteristic can hereby be realized for both the first medium and the second medium. Since in the case of the heat exchanger according to the invention, in contrast to most known heating exchangers, the flow behaviour of the two media can be influenced to a great extent by designing the respective flow channels in accordance with their flow medium, an optimized heat transfer is obtained.

Uncooled parts in the heat exchanger can further be prevented, and the design provides for the flue gas medium not to come into contact with the weld seams.

A further advantage of the simple construction of the heat exchanger according to the invention is that it can be manufactured in simple manner. While conventional heat exchangers are generally cast or assembled by welding a large number of plates to each other, the design according to the invention can be manufactured by giving three or four plates a desired form and welding them to each other. The elongate structure resulting here has the further advantage that the heat of the gas flame can be well distributed. Conventional heat exchangers constructed around the one or more gas burners have the drawback that the hot heat source is in the centre and the heat is distributed over the heat exchanger with difficulty.

According to a first preferred embodiment, the at least one outer channel defines between two adjacent protruding parts a flow direction of the second medium which is oriented substantially transversely of the flow direction of the first medium through the inner channel. This creates a transverse flow between the first medium and the second medium.

In a further embodiment of the heat exchanger according to the invention the protruding parts on either side lie opposite each other and form local widened portions of the inner channel. These widened portions function as swirl chambers, whereby the first medium is set into motion transversely of its flow direction, which results in an improved heat transfer.

In an alternative embodiment of the heat exchanger the protruding parts on either side are offset relative to each other and the inner channel has a meandering form. The path length to be covered by the flue gases is increased by this meandering.

When an intermediate space between successive protruding parts and/or one (or more) dimensions of the protruding parts varies in a flow direction of the first medium, a good and uniform heat transfer can be achieved over the whole surface area of the heat exchanger, taking into consideration the variation in the temperature differences between the media.

A structurally simple embodiment of the heat exchanger is obtained when the central body comprises at least two substantially parallel profiled plates connected locally to each other. The number of individual components is hereby reduced, and production thereby simplified.

The protruding parts of the central body can in that case be formed in simple manner by mutually parallel indentations of the plates.

An easily manufactured heat exchanger is then obtained when the indentations are substantially U-shaped or V-shaped. Such indentations can be made quickly and easily by a press or punch.

The construction of the heat exchanger is simplified still further when the housing comprises at least two substantially parallel plates extending on either side of the central body and connected locally thereto. The heat exchanger can then be constructed in its entirety from a small number of plates, a minimum of three.

The plates of the central body and/or the plates of the housing can in each case be identical here, whereby it is possible to suffice with two types of plate in the construction of the heat exchanger.

A robust but nevertheless structurally simple heat exchanger is obtained when the plates are connected to each other and/or to the central body by welds. Different welding techniques can be applied here depending on the materials used and the embodiment. Spot welding, laser welding, TIG welding and the like can be envisaged.

In order to enable easy cleaning or maintenance of the heat exchanger the profiled plates of the central body are preferably connected releasably to each other. The heat exchanger can thus be taken apart periodically.

The housing and/or the central body of the heat exchanger is/are advantageously manufactured at least partially from stainless steel and/or titanium. This material combines an excellent resistance to the effects of the through-flowing media with good heat conduction, and can still be processed in relatively simple manner.

When the inner channel is connectable to an outlet of a burner, and the one or more outer channels to a water conduit, the heat exchanger can be used to heat through-flowing using flue gases, for instance in a CH installation or a tap water system.

The invention also relates to a method for forming a heat exchanger as described above. According to the invention this method comprises the steps of giving each of a number of plates a desired profile shape, placing the thus profiled plates substantially mutually parallel onto each other and locally connecting to each other the plates placed onto each other such that at least two separate, continuous channels are defined therebetween. A heat exchanger can thus be constructed easily and quickly.

The plates can be at least partially manufactured here from stainless steel and/or titanium.

The plates can be given the desired profile shape by punching or pressing. Punching and welding are known and well-developed techniques in the manufacture of radiators, whereby the plates can be manufactured via a reliable and simple production process.

The plates can further be connected locally to each other by welds.

At least some plates can advantageously be connected releasably to each other.

When the heat exchanger comprises at least two inner and two outer plates, the inner plates can be connected releasably to each other, while the outer plates are each welded to the adjacent inner plate.

At least some plates can advantageously be provided with a repeating profile by forming mutually parallel indentations therein.

The indentations can here be substantially U-shaped or V-shaped.

A distance between successive indentations and/or a width and/or a depth of the indentations may vary over the surface of the plate.

When the heat exchanger comprises at least two inner and two outer plates, the inner plates and/or outer plates can in each case be identical.

When the heat exchanger comprises at least two inner and two outer plates, the inner plates can have a corresponding repeating profile and they can be placed onto each other such that their indentations substantially coincide, thus forming a meandering channel between the plates.

When the heat exchanger comprises at least two inner and two outer plates, the inner plates can on the other hand have a corresponding repeating profile and be placed back to front onto each other such that their mutually opposite indentations form local widened portions in a channel defined between the plates.

Finally, the invention further relates to a method for bringing a first medium and a second medium into heat-exchanging contact with each other, wherein the first and second media flow along each other via a heat-exchanging surface.

In the method of heat exchange according to the invention the first medium flows in a first main direction and in a second direction substantially transversely thereof, and the second medium flows substantially parallel to the first main direction and in a third direction, wherein the third direction lies substantially transversely of both the first main direction and the second direction. Allowing the media to thus flow along each other in different directions creates a good heat transfer.

When the first medium periodically flows out and flows back on either side of the first main direction, the flow of this medium becomes turbulent, whereby the medium comes into full heat-exchanging contact with the second medium.

A similar effect can be achieved when the first medium follows a meandering flow path.

For an optimal heat transfer, the second medium can in both cases also follow a meandering flow path.

The heat exchanger preferably comprises a meandering flow path for both the inner channel and the outer channel. By embodying both channels as a meandering flow path the flow of the first medium in the inner channel, for instance combustion gases, and of the second medium in the outer channel, for instance water for heating, can be influenced such that an optimal heat transfer can be realized.

The first medium can here be gaseous and the second medium liquid. When the method is applied in a CH installation or tap water system, the first medium can comprise flue gases coming from a burner and the second medium can be water.

In order to prevent the temperature rising too high in the area surrounding the heat exchanger, it is recommended that the second medium flows substantially wholly around the first medium.

BRIEF DESCRIPTION OF THE DRAWINGS

The invention will now be elucidated on the basis of a number of examples. Reference is made here to the accompanying drawing, in which.

DETAILED DESCRIPTION

Figure 1:
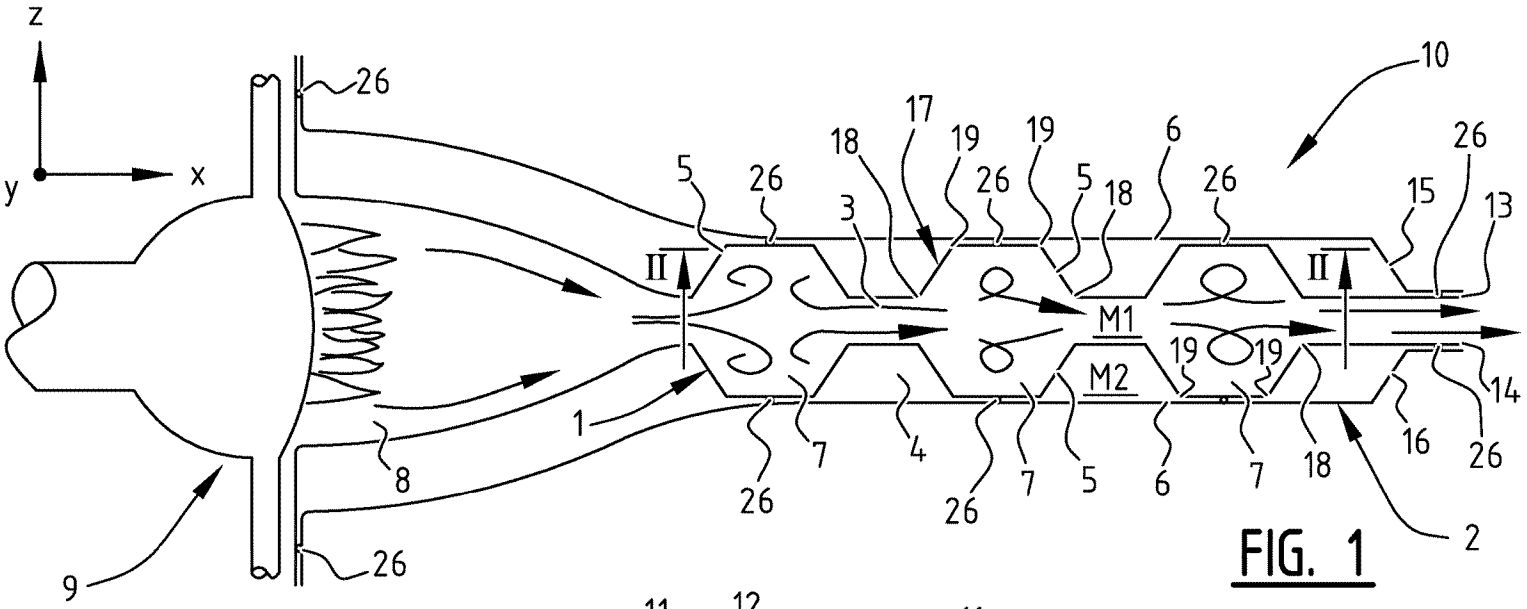
FIG. 1 is a schematic longitudinal section through a burner and a heat exchanger according to a first embodiment of the invention.
Figure 2:
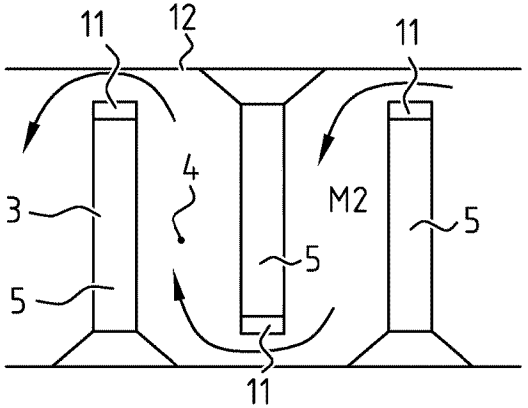
FIG. 2 shows a section along the line II-II in FIG. 1.

A heat exchanger 10 (FIG. 1) comprises a hollow central body 1 which is received in a housing 2 and defines an inner channel 3 for a first medium M1. A space 4 in housing 2, which surrounds central body 1, here defines an outer channel for a second medium M2. Central body 1 has a main plane which is parallel to the flow direction of the first medium M1, so here in XY-direction, transversely of the plane of the drawing. Central body 1 has parts 5 protruding on either side from this main plane and connected to mutually opposite walls 6 of housing 2. Protruding parts 5 do not extend over the whole width of housing 2 but in each case leave clear a passage between their closed outer end 11 and one of the side walls 12 of housing 2 (FIG. 2). Protruding parts 5 thus bound outer channel 4 in a manner such that this channel 4 has a meandering form parallel to the main plane of central body 1, so in XY-direction. The meandering form in the XY-direction provides a transverse flow of the two heat-exchanging media M1 and M2, wherein in the outer channels 4 enclosed between two adjacent protruding parts 5 the second medium M2 is oriented substantially transversely of the flow direction of the first medium M1 through inner channel 3. In the shown embodiment the protruding parts 5 lie opposite each other on either side and form local widened portions 7 in inner channel 3. Turbulence is created in these widened portions 7, which act as swirl chambers, and the first medium M1 is set into motion transversely of its flow direction, so in Z-direction. A good heat transfer is guaranteed by the movement of the two media M1, M2 in different directions.

Inner channel 3 is connected here to an outlet 8 of a burner 9, while outer channel 4 is connected to a water conduit (not shown here). It is noted that the design of heat exchanger 10 provides space for a wide burner 9, this having the advantage that it has a relatively large burner area. Inner channel 3 can be formed integrally with outlet 8. A fuel/air mixture is combusted in burner 9, and the resulting flue gases here form the first medium M1. The second medium M2 in outer channel 4, so in this case through-flowing water which for instance circulates in a CH installation or is drawn off as tap water, is heated to a desired temperature by means of these flue gases. In the shown example the water M2 otherwise flows through heat exchanger 1 parallel to but in opposite direction to the flue gases M1.

Central body 1 and housing 2 are each formed here by respective pairs of mutually connected plates 13, 14 and 15, 16. Plates 13, 14 forming the walls of central body 1 are thus profiled here, while plates 15, 16 forming outer walls 6 of housing 2 are in this embodiment substantially flat—although curved to some extent so as to form a connection between the relatively great height of outlet chamber 8 and the thinner heat exchanger 10.

The profile of plates 13, 14 is formed in this example by a series of parallel indentations 17 in the originally flat plates. Plates 13, 14 are identical here but are placed back to front onto each other, whereby indentations 17 are directed away from each other and form the widened portions 7 of inner channel 3. Indentations 17 otherwise have a flat U-shape with sharp edges 18, 19. The legs of the U-shape between edges 18, 19 and the bottom of the U-shape are flat here, whereby indentations 17 can be shaped in simple manner in the initially flat plate. Different techniques, such as punching or pressing, or even rolling, can be used to form the indentations. These techniques are applied for instance in the manufacture of radiators and are reliable and simple, and thereby cost-effective.

In the shown example plates 13-16 are manufactured from stainless steel. Protruding parts 5 of plates 13, 14 of central body 1 are attached here to plates 15, 16 of housing 2 by means of welds 26. Different welding techniques can be used here, such as spot welding, TIG welding or laser welding. The end edges of the different plates 13-16 are also mutually connected in order to close housing 2 and central body 1—with the exception of the inflow and outflow openings—and to prevent direct contact of media M1 and M2. The above stated welding techniques can also be used for these end connections.

In the shown example the dimensions of indentations 17 and their mutual distance are always the same. Inner and outer channels 3, 4 are hereby formed, the throughflow area of which close to the outflow side is in principle the same as that close to the inflow side. The flow rates of media M1, M2 between the inflow and outflow sides will then substantially not vary either.

Figure 3:
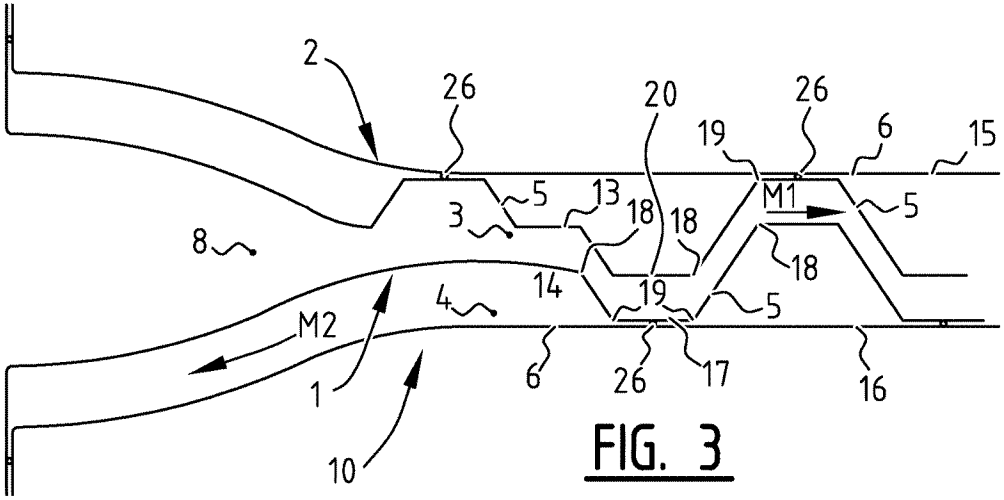
FIG. 3 is a schematic longitudinal section through a second embodiment of the heat exchanger according to the invention.

In an alternative embodiment (FIG. 3) protruding parts 5 are offset relative to each other in the flow direction of media M1, M2. They do not hereby form local widened portions in an otherwise straight channel, but provide inner channel 3 with a meandering form. As in the first embodiment, plates 13, 14 which define central body 1 can be largely identical and placed back to front onto each other, but then offset. Relatively wide indentations 17 hereby lie opposite relatively narrow upright parts 20, thereby forming a meandering inner channel 3 with relatively sharp bends.

Figure 4:
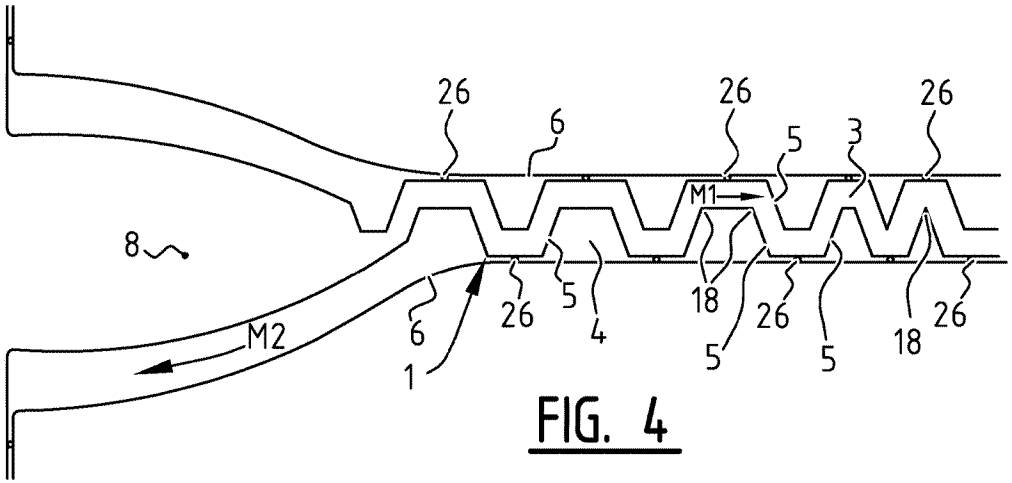
FIG. 4 shows a section corresponding to FIG. 3 on a smaller scale.

In this embodiment the form and dimensions of protruding parts 5 and the intermediate space between successive protruding parts 5 otherwise vary in the flow direction of media M1, M2 (FIG. 4). In the flow direction of the flue gases M1, so as seen from outlet 8 of burner 9, the width of indentations 17 and the distance between successive indentations 17 decreases such that the upright edges between indentations 17 eventually change from flattened U-shaped to V-shaped. Inner channel 3 then has practically no more parts running parallel to the main plane of central body 1, but only meanders around it. By varying the form of channels 3, 4 the temperature variation of media M1, M2 can be taken into account as well as possible and a maximal heat transfer can be achieved at every point in heat exchanger 10.

Figure 5:
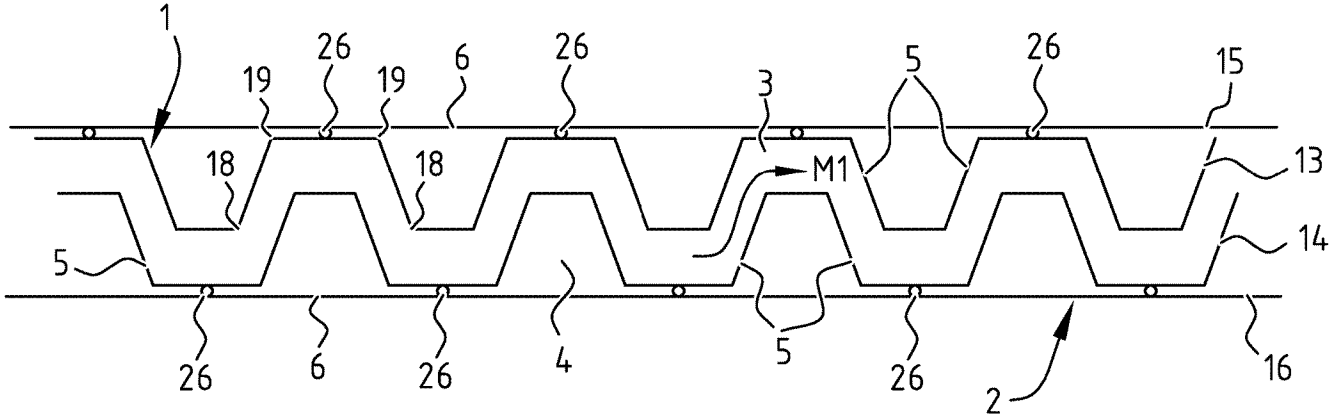
FIG. 5 is a longitudinal section through a part of a heat exchanger according to a third embodiment.

In a variant of this embodiment the protruding parts 5 are still offset, so that inner channel 3 has a meandering form. The width of indentations 17 and their mutual distance is however constant here, whereby channel 3 has a regularly repeating form (FIG. 5). The throughflow areas of the inner and outer channels 3, 4 are also substantially constant here as seen in flow direction, as are the flow rates of media M1, M2.

Figure 6:
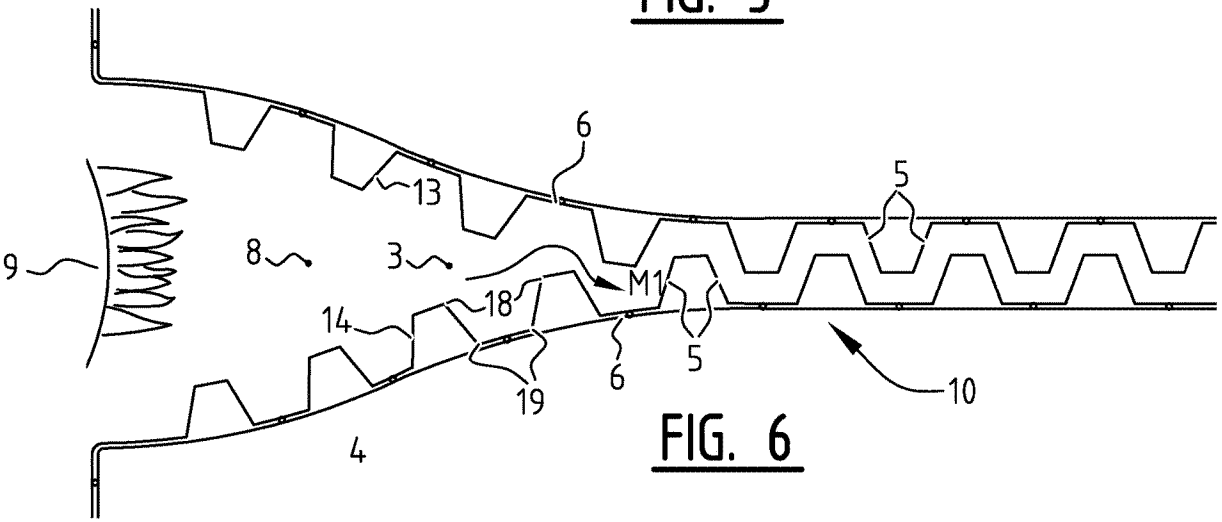
FIG. 6 is a schematic longitudinal section through a fourth embodiment of the heat exchanger according to the invention with a part of a burner.

Another embodiment is characterized in that the plates 13, 14 which form central body 1 follow the form of plates 15, 16 of outer walls 6 of housing 2 (FIG. 6). Inner channel 3 hereby has on the inflow side, close to burner 9 and its outlet 8, a relatively large throughflow area which then decreases in flow direction of the flue gases M1 as outer walls 6 of housing 2 come closer together.

Figure 7:
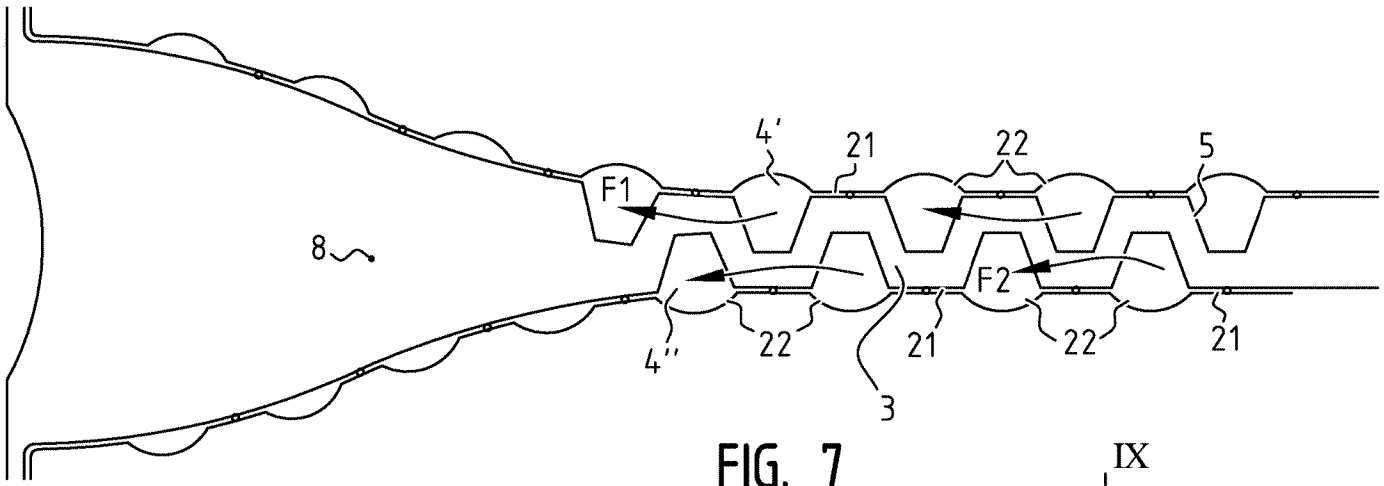
FIG. 7 shows a section corresponding to FIG. 4 of a fifth embodiment of the heat exchanger.

In yet another embodiment of heat exchanger 10 it is not only plates 13, 14 forming the central body which are profiled, but also plates 15, 16 which form housing 2 (FIG. 7). These plates 15, 16 have straight pieces 21 to which protruding parts 5 of inner channel 3 are attached, with indentations 22 therebetween. In the shown example these indentations 22 are provided with rounded edges, or even form a curved whole. Optimal flow conditions are hereby created for the liquid medium M2. Straight pieces 21 are otherwise fixed close to burner 9 to the wall of outlet 8 so that here too the outer channel 4 also has a meandering form. As indicated by arrows F1 and F2, indentations 22 on either side of inner channel 3 form in this example two separate outer channels 4' and 4", whereby two part-flows of liquid M2 are heated by flue gases M1.

Figure 8:
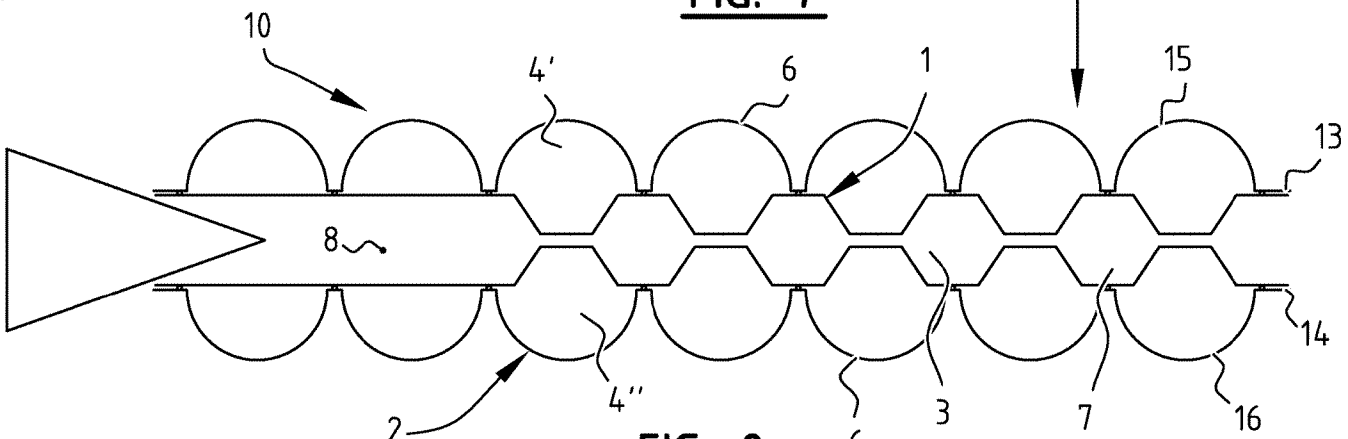
FIG. 8 shows a variant of this embodiment.
Figure 9:
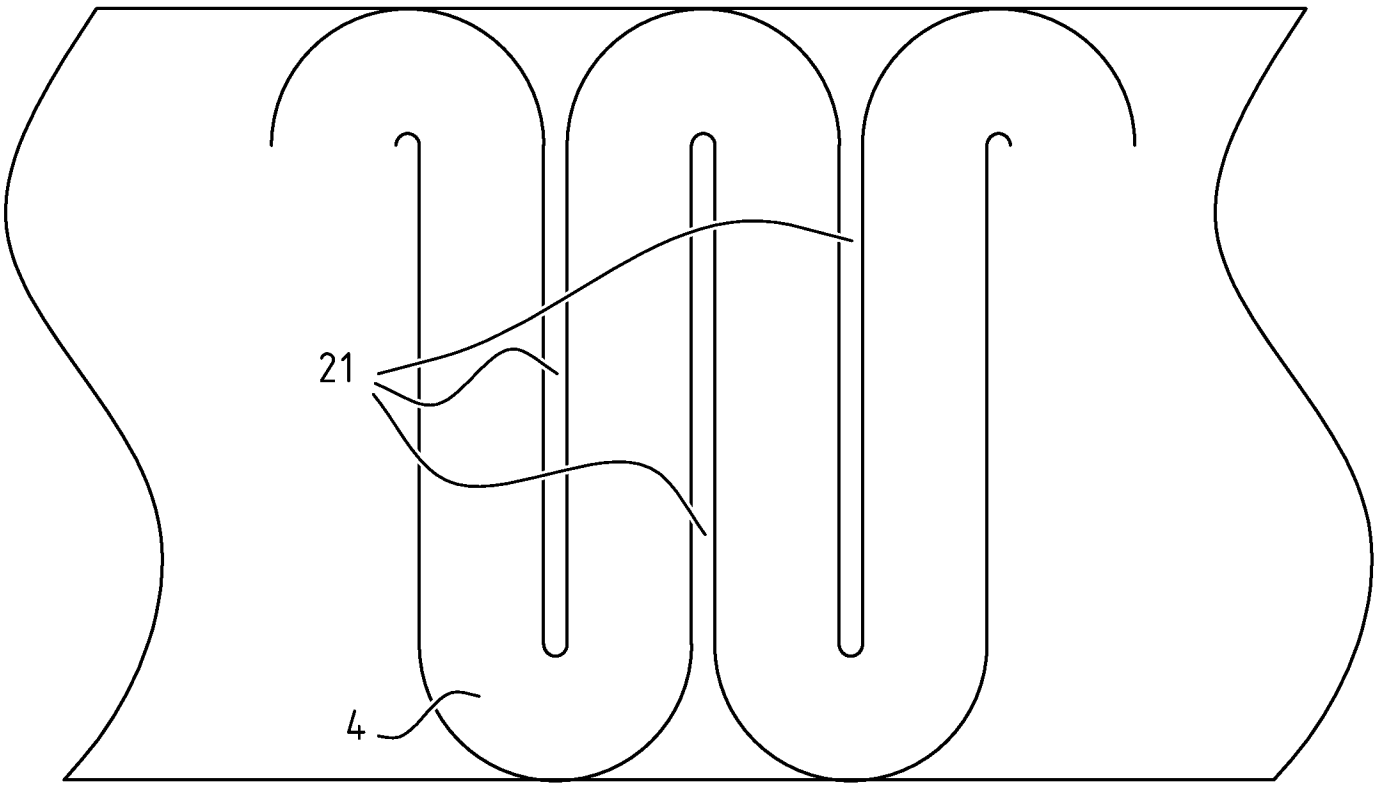
FIG. 9 is a schematic top view as according to arrow IX in FIG. 8.

In a variant of this embodiment the straight pieces 21 of plates 15, 16 which form outer walls 6 of housing 2 are so narrow that in cross-section the plates 15, 16 resemble a series of mutually connected arches (FIG. 8). Outer channels 4' and 4" then thus have a meandering form with relatively narrow loops which are connected to each other via tight bends and are only separated by the punched intermediate wall (FIG. 9). Plates 13, 14 which form central body 1 are in this case not offset, and so again form with their indentations 17 local widened portions 7 in inner channel 3. Achieved in this embodiment due to the form of outer walls 6 of housing 2 is that inner channel 3 is wholly enclosed by the liquid M2 in outer channel 4. The outer side of heat exchanger 10 thus remains cool. In this embodiment outlet chamber 9 of burner 8 otherwise takes an elongate form with straight walls This outlet chamber 9 can hereby be formed in simple manner from plates 13, 14 in the same way as inner channel 3.

In this embodiment each pair of plates 13, 14 and 15, 16 is further symmetrical relative to the main plane of central body 1. Heat exchanger 10 can hereby be given a divisible form in simple manner. Plates 13, 14 are for this purpose connected releasably to each other, while plates 15, 16 are each attached permanently to a corresponding plate 13, 14, for instance welded thereto. Each respective set of mutually attached plates 13, 15 and 14, 16 forms an identical module here. Heat exchanger 10 can in this way be taken apart again if desired, for instance in order to clean channels 3, 4 or for maintenance operations.

Figure 10:
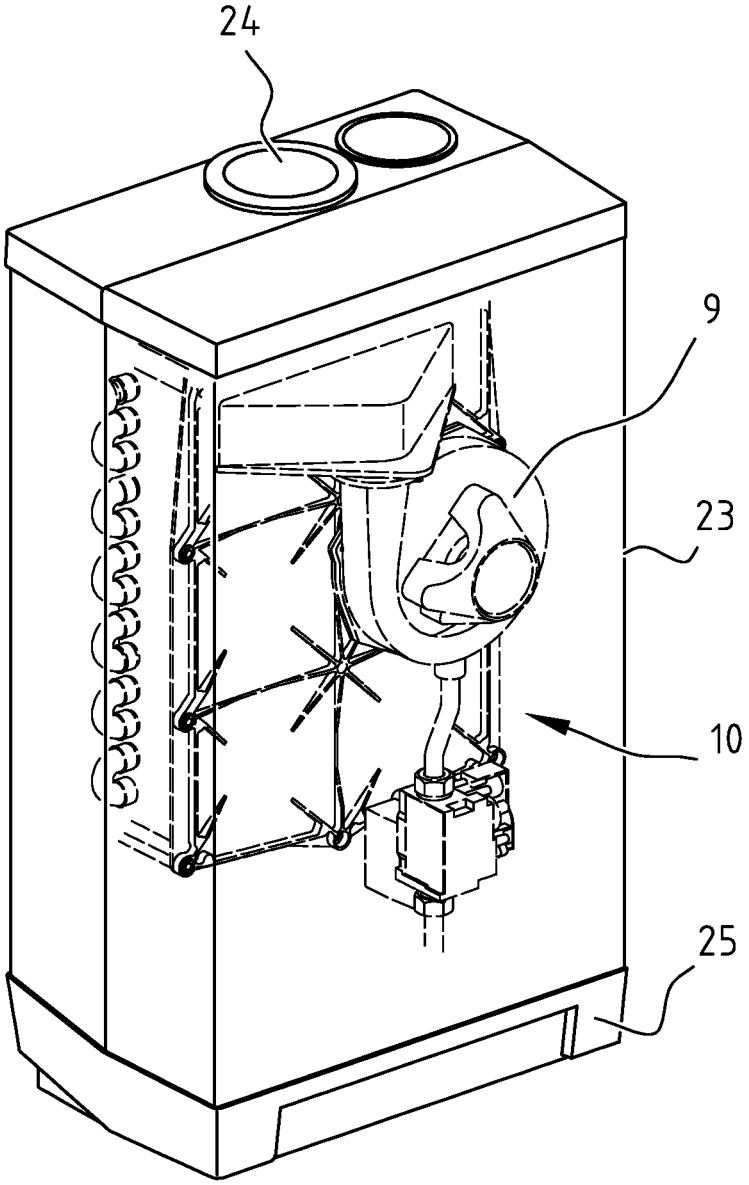
FIG. 10 is a schematic view of an installation with a burner, a heat exchanger according to the invention, a water connection and a flue gas discharge.

Heat exchanger 10 and burner 8 are in practice often received in a vertically oriented casing 23 which is intended for suspension on a wall (FIG. 10). In the shown example burner 8 is placed here above heat exchanger 10, which is in turn also oriented vertically. Flue gases M1 are guided downward through inner channel 3 of heat exchanger 10, and there flow into an upward oriented outlet pipe 24. Water M2 for heating is at the same time fed via a connection 25 on the underside of casing 23 to outer channel 4 of heat exchanger 10. This water M2 eventually leaves casing 23 via a second connection, which is not shown here but will in practice also often be arranged on the underside.

Figure 11:
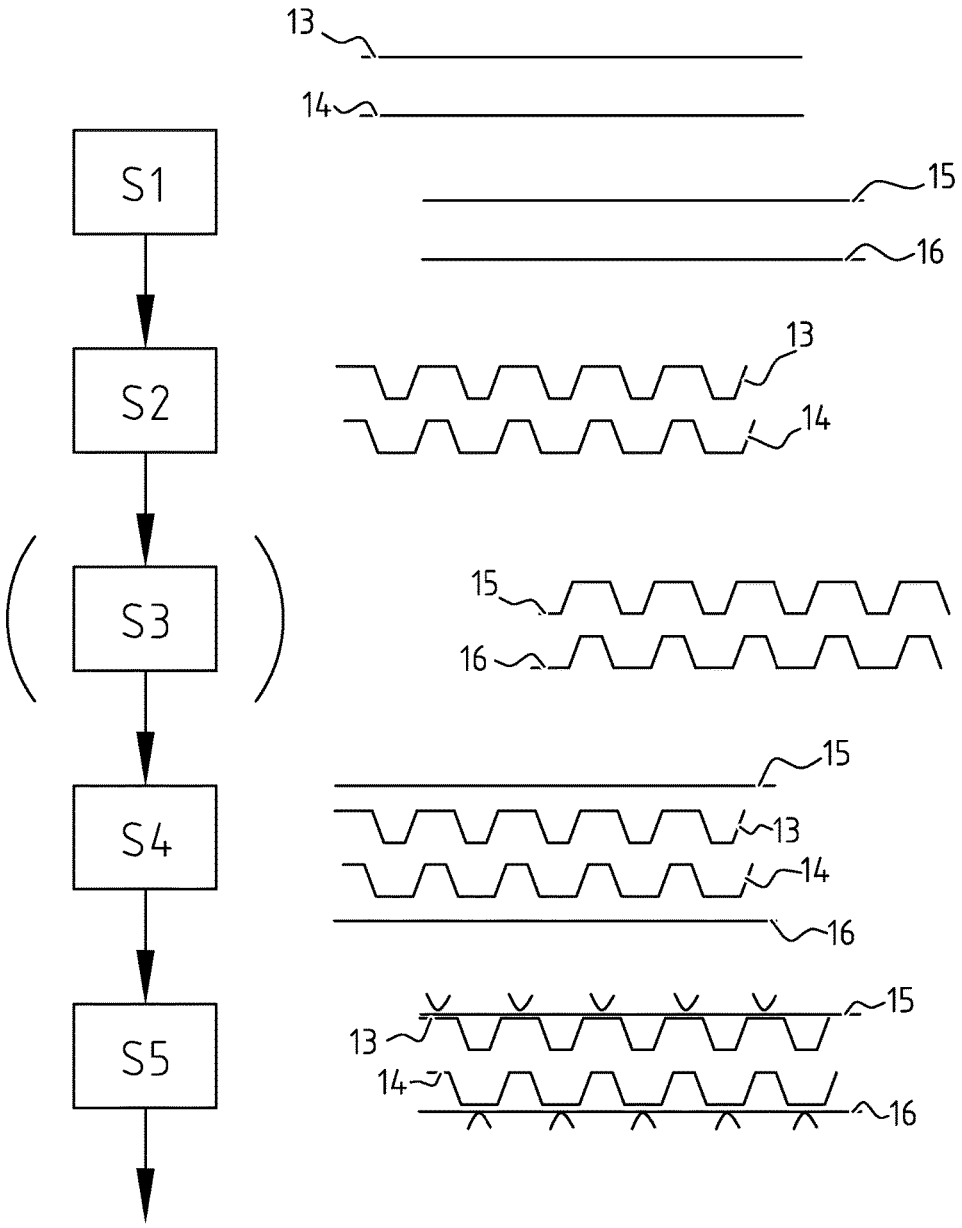
FIG. 11 shows schematically the most important steps of a method for manufacturing a heat exchanger according to the invention.
Figure 12A:
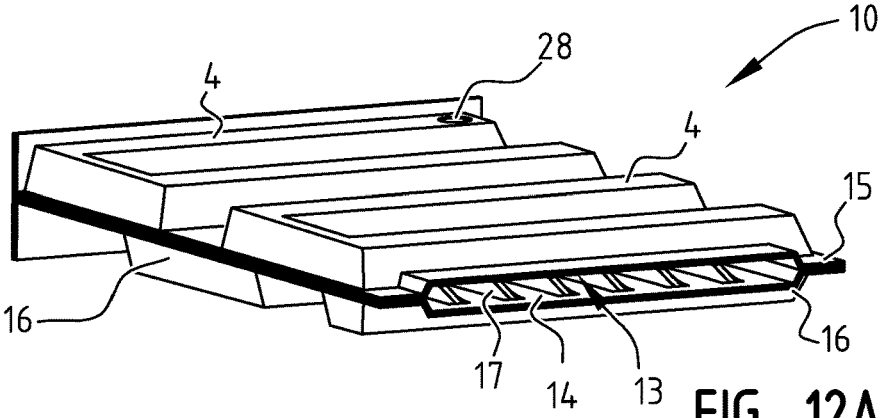
FIG. 12A is a perspective view of a seventh embodiment of the heat exchanger.
Figure 12B:
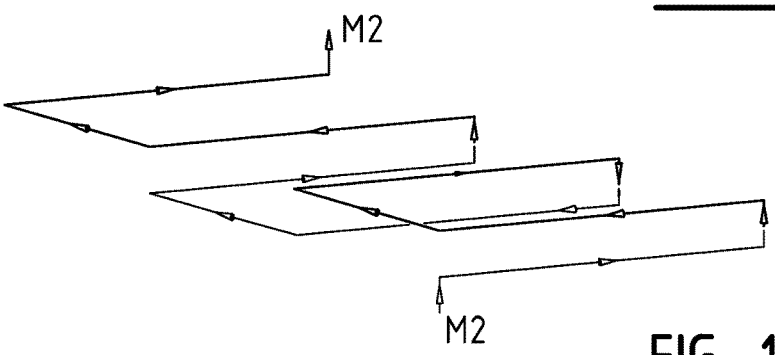
FIG. 12B is a schematic view of the water flow through the heat exchanger shown in FIG. 12A.

A method for forming a heat exchanger 10 as described above comprises the first step S1 of supplying a number of plates 13-16, manufactured for instance from stainless steel or titanium (FIG. 11). In any case the plates 13, 14 which will form central body 1 of heat exchanger 10 are then provided with a profile in a second step S2. These plates 13, 14 are subjected for this purpose to for instance a pressing or punching operation. In order to form a heat exchanger 10 as according to FIG. 7-9, plates 15, 16 of housing 2 must also be subjected in a step S3 to a pressing or punching operation so as to be profiled. This step S3 is of course not necessary for heat exchangers 10 with flat outer walls 6. Plates 13-16 are then brought into the correct position relative to each other (step S4) and finally connected to each other (step S5). For a fully welded heat exchanger 10 the plates 13, 14 can first be welded to each other, and plates 15, 16 are then welded thereto. For a heat exchanger which it must be possible to disassemble, plates 15, 16 can first be welded to a corresponding plate 13, 14, and plate pairs 13, 15 and 14, 16 are then connected releasably to each other. A heat exchanger 10 can thus be formed quickly and efficiently, with a relatively small number of simple operations which are moreover readily automated.

A heat exchanger 10 according to the invention is therefore easy to manufacture and has a relatively small number of individual components. It is possible with heat exchanger 10 according to the invention to form a relatively large heat-exchanging surface area while using relatively little material. The vicinity of heat exchanger 10 is moreover relatively cool because the water M2 flows substantially wholly around the hot flue gases M1.

FIGS. 12A, 12B, 13 and 14 show a seventh embodiment of heat exchanger 10, wherein a single flow of the water M2 alternates between the upper side and underside of plates 13, 14, which together enclose the labyrinth through which the hot flue gases M1 flow.

Figure 13:
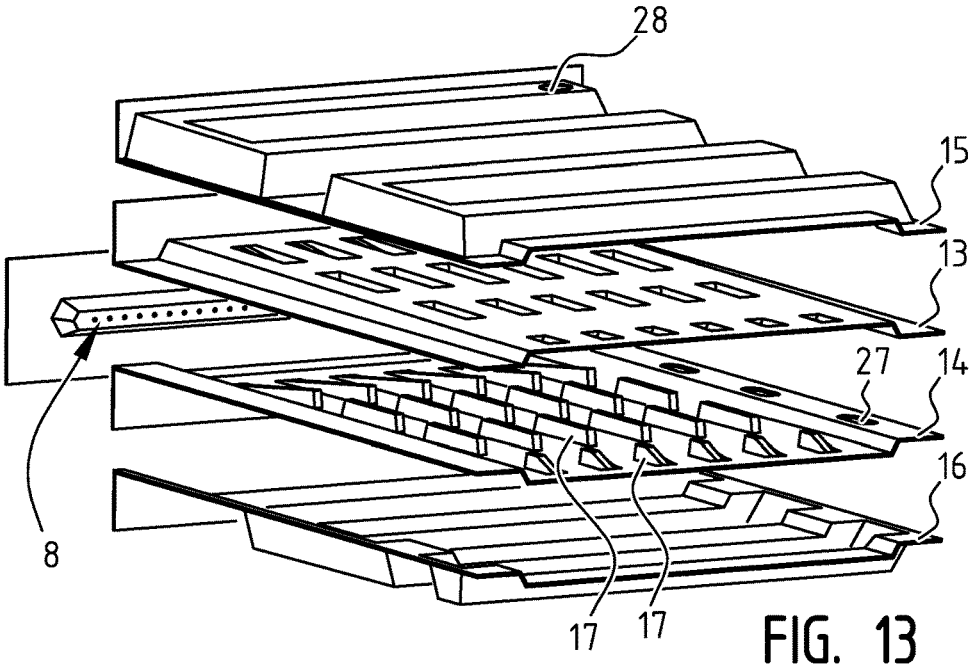
FIG. 13 is an exploded view of the heat exchanger of FIG. 12A.
Figure 14:
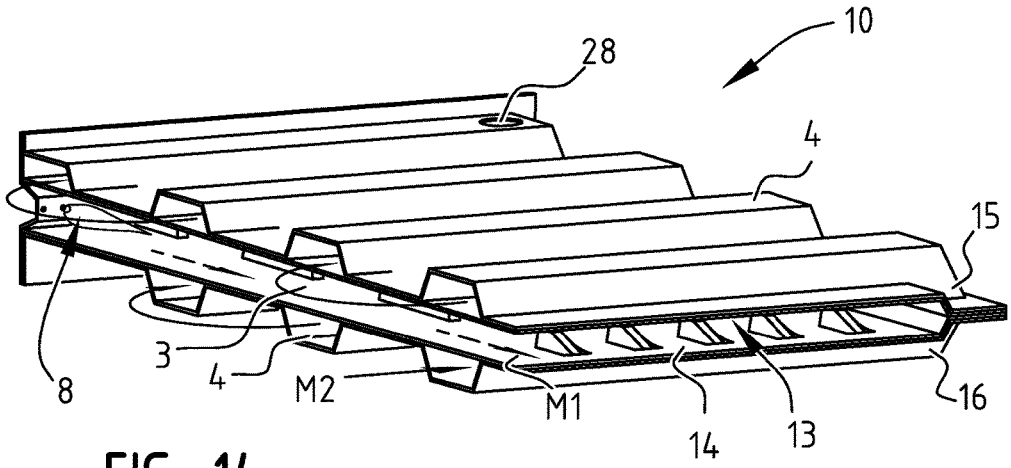
FIG. 14 is a cross-sectional view of the heat exchanger of FIG. 12A.

As shown particularly clearly in the exploded view of FIG. 13, plates 13, 14 are provided with indentations 17. Indentations 17 are interrupted locally, whereby plates 15, 16 together with plates 13, 14 enclose an outer channel 4 through which the water M2 can flow.

Plates 13, 14 together enclose inner channel 3 which forms the flue gas labyrinth. Indentations 17 here ensure that the hot flow of flue gases M1 swirls and mixes.

At least one side edge of plates 13, 14 is provided with passage openings 27 through which the water flow M2 can flow from the underside to the upper side and vice versa. Outer channel 4 is provided at the outer end with an outflow opening 28 through which the heated water M2 can leave heat exchanger 10.

Figure 15:
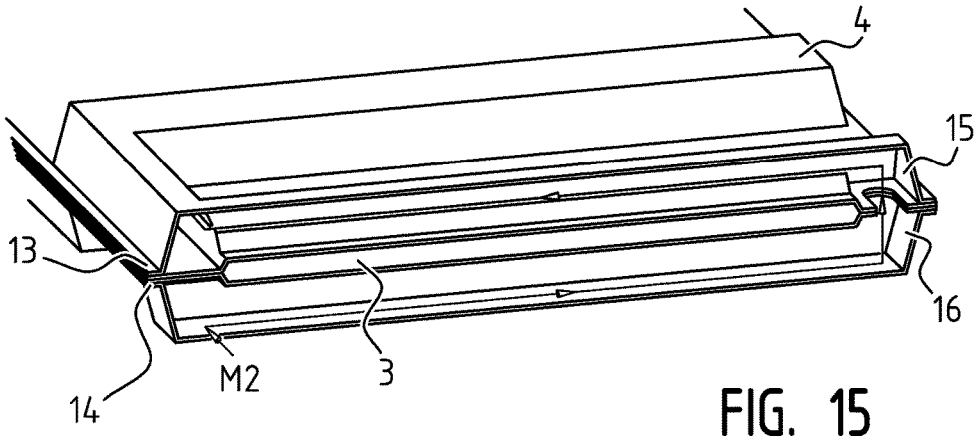
FIG. 15 shows a cross-section of an eighth embodiment of the heat exchanger.

Also shown in the cross-section shown in FIG. 15 of an eighth embodiment of heat exchanger 10 is the water flow M2 which flows through passage openings from the underside to the upper side. In this eighth embodiment inner channel 3 is provided with successive chambers (not shown) in which the hot flue gases M1 swirl and mix. Such swirl chambers correspond to the configuration shown in FIG. 1.

Figure 16A:
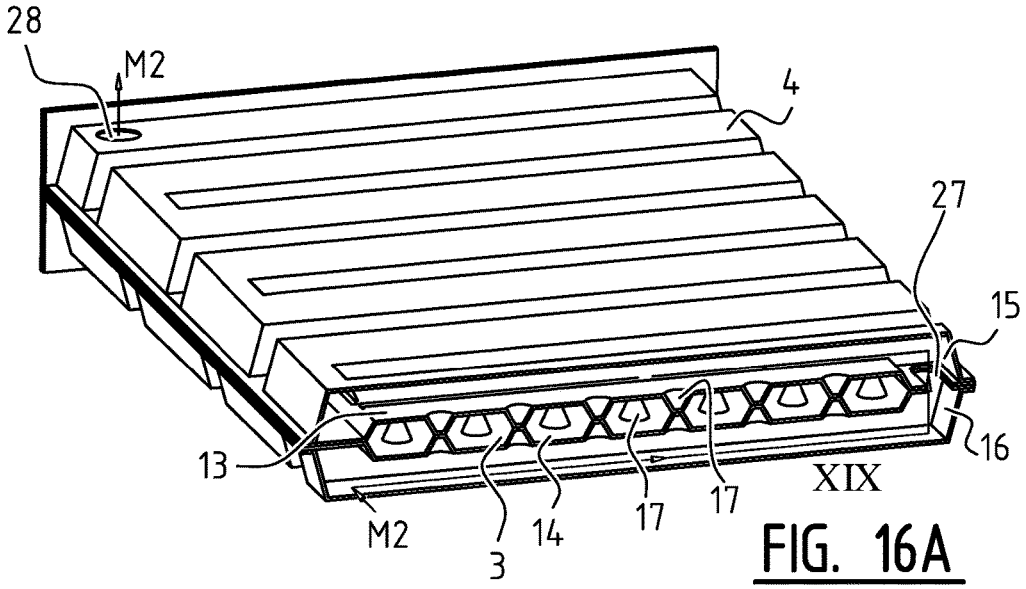
FIG. 16A is a perspective cross-sectional view of a ninth embodiment of the heat exchanger.
Figure 16B:
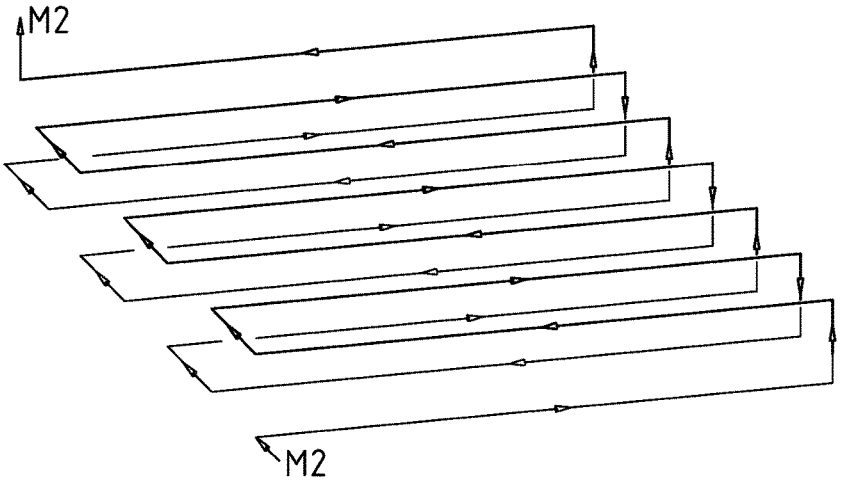
FIG. 16B is a schematic view of the water flow through the heat exchanger shown in FIG. 16A.

The ninth embodiment shown in FIGS. 16A and 16B once again comprises an inner channel 3 for transporting hot flue gases M1 which is formed by two plates 13, 14 arranged against each other. Indentations 17 connect plates 13, 14 locally and thus form a labyrinth for the hot flue gases M1. Water flow M2 flows from an inlet (not shown) and via passage openings 27 through outer channel 4 in the direction of outflow opening 28. During flow through outer channel 4 of heat exchanger 10 the water M2 is heated by the heat released from the hot flue gases M1. FIG. 16B shows schematically the flow of water M2 through heat exchanger 10 of FIG. 16A.

Figure 17:
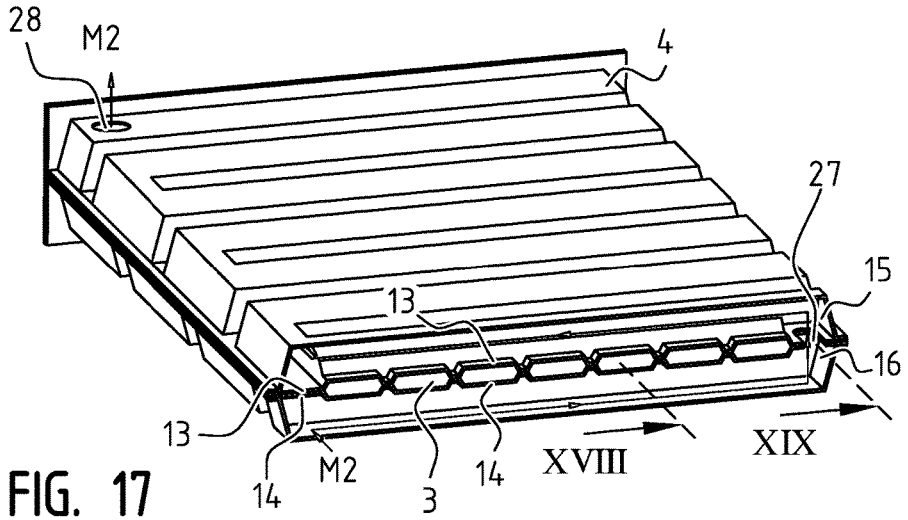
FIG. 17 is a perspective cross-sectional view of a tenth embodiment of the heat exchanger.
Figure 18:
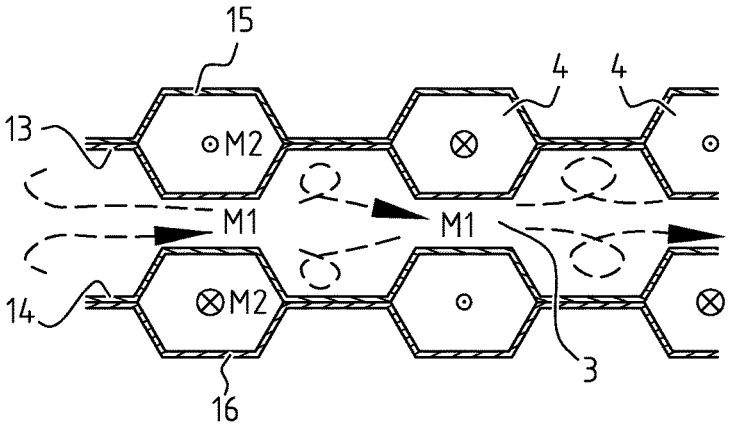
FIG. 18 shows a section as according to arrow XVIII in FIG. 17.
Figure 19:
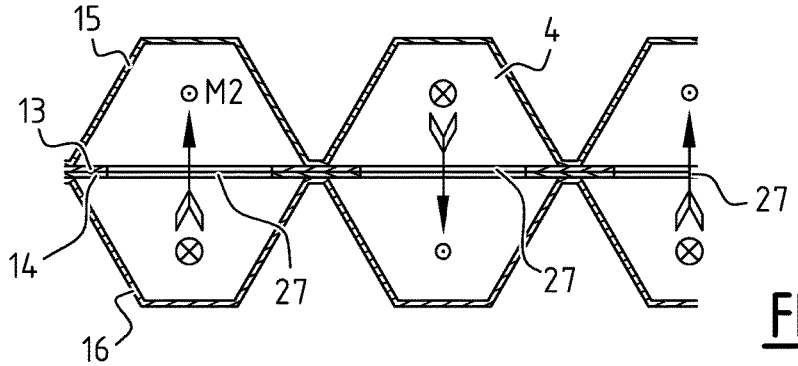
FIG. 19 shows a section as according to arrow XIX in FIG. 17.

The tenth embodiment of heat exchanger 10 is shown in FIGS. 17-19, wherein FIGS. 18 and 19 show cross-sections as according to respective arrows XVIII and XIX in FIG. 17. Inner channel 3 alternately comprises passages with a narrow cross-section and passages with a wide cross-section. At the position of the wide passages a chamber is created between plates 3, 4, where the flow of hot flue gases M1 begins to swirl and mix, which improves the heat transfer to the water M2 flowing through outer channels 4. The cross-section of FIG. 19 is at the position of passage openings 27 through which the flow of water M2 flows upward from below and vice versa. A single outer flow channel 4 can in this way run along both the underside and the upper side of inner channel 3. For this embodiment the water flow M2 corresponds to the water flow as shown schematically for the ninth embodiment in FIG. 16B.

The use of a single flow channel 4 has the advantage that on the one hand a blockage is not likely to occur and will on the other hand, in the unlikely event a blockage should occur, be quickly detected.

It is nevertheless possible to envisage water flow M2 through flow channel 4 being divided into two flows: a first flow along the underside of inner channel 3 and a second flow along the upper side of inner channel 3. Such an embodiment is shown in FIGS. 20A and 20B, wherein FIG. 20B shows water flow M2 schematically.

Figure 20A:
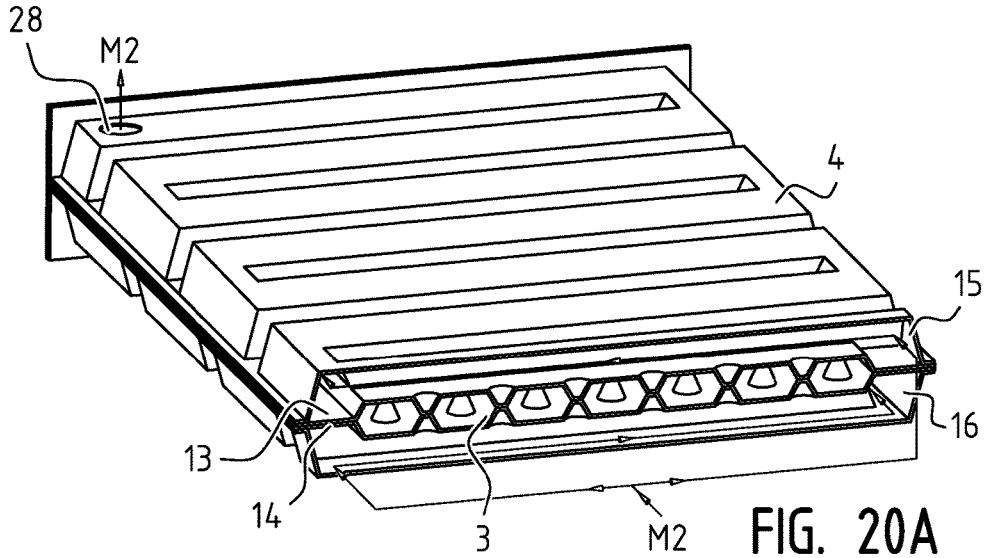
FIG. 20A is a perspective cross-sectional view of an eleventh embodiment of the heat exchanger.
Figure 20B:
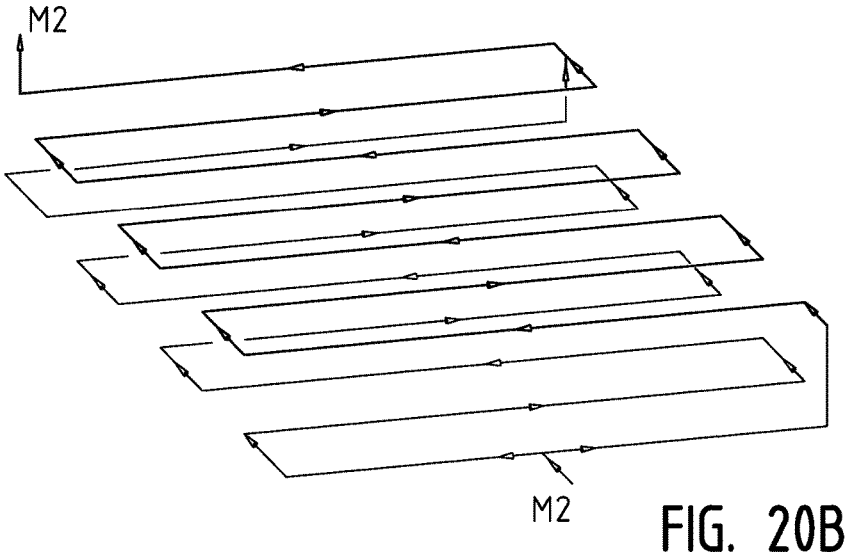
FIG. 20B is a schematic view of the water flow through the heat exchanger shown in FIG. 20A.
Figure 21:
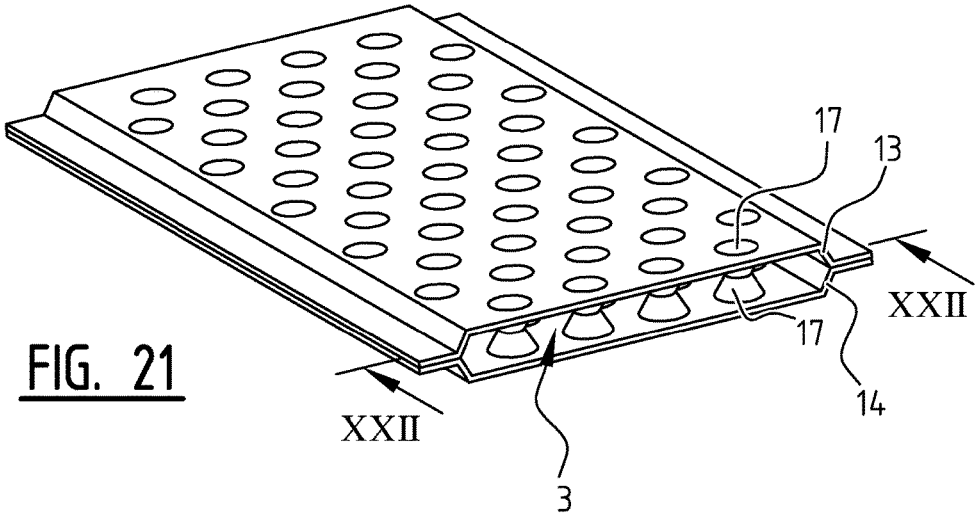
FIG. 21 is a perspective view of the plates which together form the flue gas labyrinth of the heat exchanger according to FIGS. 16A and 20A.
Figure 22:
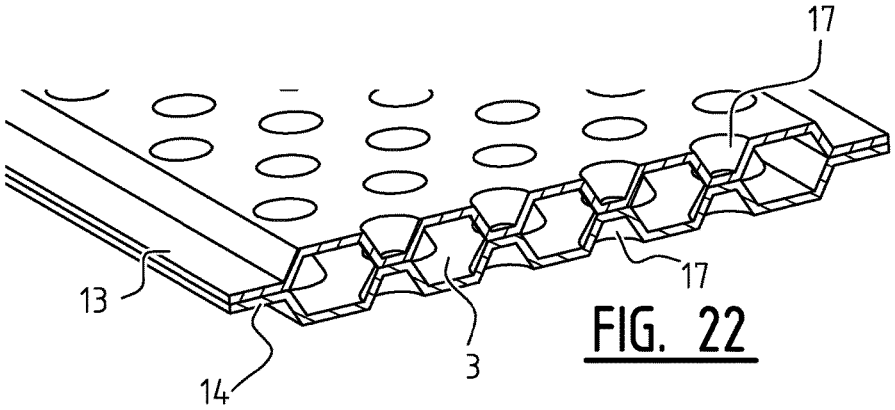
FIG. 22 is a perspective cross-sectional view as according to arrow XXII in FIG. 21.

Finally, FIGS. 21 and 22 show plates 13, 14 of the above described ninth embodiment (FIGS. 16A and 16B) and eleventh embodiment (FIGS. 20A and 20B). Plates 13, 14 are provided with indentations 17 which in the assembled situation come to lie against each other and thus form a labyrinth in inner channel 3 through which the hot flue gases M1 will meander.

Although they show preferred embodiments of the invention, the above described embodiments are intended only to illustrate the present invention and not to limit the specification of the invention in any way.

Is noted that for the sake of clarity the water course is shown in the figures with relatively large offsetting between parallel channels: in reality the channels can lie much closer against each other, whereby the heat transfer between the hot flue gases M1 and the water flow M2 is improved.

When measures in the claims are followed by reference numerals, such reference numerals serve only to contribute toward understanding of the claims, but are in no way limitative of the scope of protection. It is particularly noted that the skilled person can combine technical measures of the different embodiments. The rights described are defined by the following claims, within the scope of which many modifications can be envisaged.

The invention claimed is:

1. A heat exchanger, comprising:

a central body that is hollow which is received in a housing and defines an inner channel for a first medium, wherein a space surrounding the central body in the housing defines at least one outer channel for a second medium, wherein the central body has on either side parts protruding from a main plane thereof and the central body comprises at least two substantially parallel profiled plates connected locally to each other, wherein the parts protruding from the main plane of the central body are connected to mutually opposite parts of the housing, wherein the protruding parts bound the outer channel, wherein the outer channel has a meandering form substantially parallel to the main plane of the central body, the meandering form defining a flow path for the second medium that alternates between first and second flow directions for the second medium that are transverse to a direction of flow of the first medium and directly opposite one another, wherein an outlet for the first medium and an inlet for the second medium share a first side of the central body and wherein an inlet for the first medium and an outlet for the second medium share a second side of the hollow central body.

2. Heat exchanger as claimed in claim 1, wherein each of the first and second flow paths for the second medium extend between two adjacent protruding parts.

3. Heat exchanger as claimed in claim 1, wherein the protruding parts on either side lie opposite each other and form local widened portions of the inner channel.

4. Heat exchanger as claimed in claim 1, wherein the protruding parts on either side are offset relative to each other and the inner channel has a meandering form.

5. Heat exchanger as claimed in claim 1, wherein an intermediate space between successive protruding parts and/or dimensions of the protruding parts varies/vary in a flow direction of the first medium.

6. Heat exchanger as claimed in claim 1, wherein the protruding parts of the central body are formed by mutually parallel indentations of the substantially parallel profiled plates.

7. Heat exchanger as claimed in claim 6, wherein the indentations are substantially U-shaped or V-shaped.

8. Heat exchanger as claimed in claim 1, wherein the housing comprises at least two substantially parallel housing plates extending on either side of the central body and connected locally thereto.

9. Heat exchanger as claimed in claim 8, wherein the substantially parallel profiled plates of the central body or the substantially parallel housing plates of the housing are identical.

10. Heat exchanger as claimed in claim 8, wherein the substantially parallel housing plates and the substantially parallel profiled plates are connected to each other by welds.

11. Heat exchanger as claimed in claim 5, wherein the profiled plates of the central body are connected releasably to each other.

12. Heat exchanger as claimed in claim 1, wherein the housing and/or the central body of the heat exchanger is/are manufactured at least partially from stainless steel and/or titanium.

13. Heat exchanger as claimed in claim 1, wherein the inner channel is connectable to an outlet of a burner, and the outer channel to a water conduit.

14. Heat exchanger as claimed in claim 1, wherein the first medium is a heating medium and the second medium is a to be heated medium.

15. Heat exchanger as claimed in claim 1, wherein the protruding parts extend from one sidewall toward the opposed sidewall with a closed end of the protruding part being spaced from the opposed sidewall such that the second medium flows between the closed end and the opposed sidewall.

* * * * *